United States Patent [19]

Butler

[11] Patent Number: 4,916,859

[45] Date of Patent: Apr. 17, 1990

[54] ASSAULT-RESISTANT GATE

[75] Inventor: Colin Butler, Putney, Vt.

[73] Assignee: Embassy Gate Associates, L.P., Cressona, Pa.

[21] Appl. No.: 240,537

[22] Filed: Aug. 29, 1988

Related U.S. Application Data

[63] Continuation-in-part of Ser. No. 157,828, Feb. 19, 1988, which is a continuation of Ser. No. 70,272, Jul. 6, 1987, abandoned, which is a continuation of Ser. No. 751,092, Jul. 2, 1985, abandoned.

[51] Int. Cl.[4] ..... E01F 13/00

[52] U.S. Cl. ..... 49/9; 404/6

[58] Field of Search ..... 49/9, 34, 49; 404/6

[56] References Cited

U.S. PATENT DOCUMENTS 4,818,137 4/1989 Gorlov ..... 49/9

*Primary Examiner*—Kenneth J. Dorner
*Assistant Examiner*—Gerald A. Anderson
*Attorney, Agent, or Firm*—Dann, Dorfman, Herrell and Skillman

[57] ABSTRACT

An assault-resistant gate is intended to bar passage, through an opening, of large vehicles moving at high velocity. The gate has a relatively strong hinge-post. A beam extends from the hinge-post across the opening. The beam is relatively rigid in a horizontal plane. The beam is attached to the hinge-post by a breakaway mounting. The attachment is weaker than the hinge-post. Energy absorbing material is disposed behind the beam on either side of the opening.

26 Claims, 10 Drawing Sheets

FIG. 3
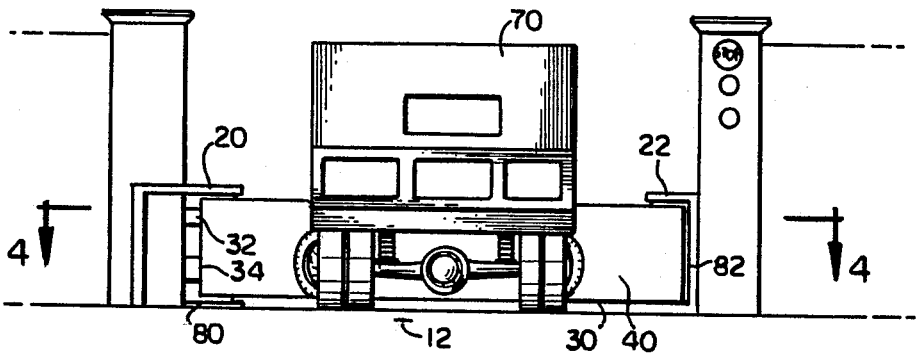
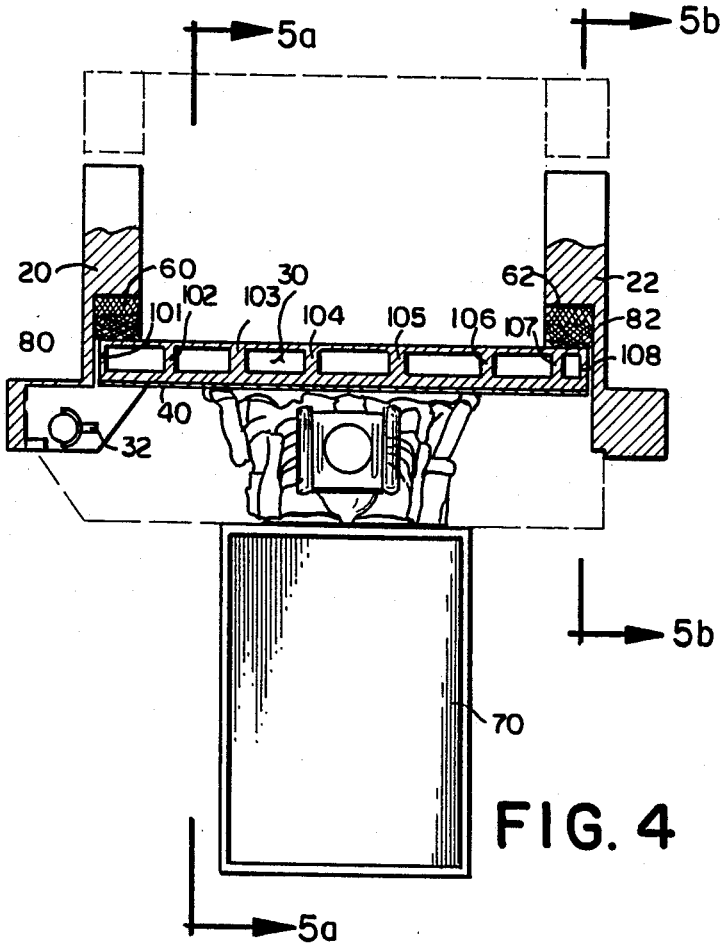
FIG. 4

ASSAULT-RESISTANT GATE

This is a continuation-in-part of U.S. patent application Ser. No. 07/157,828, filed Feb. 19, 1988, now pending which is a continuation of Ser. No. 070,272, filed July 6, 1987, now abandoned; which is a continuation of Ser. No. 06/751,092, now abandoned. Priority is claimed from those dates on any subject matter these applications may have in common.

FIELD OF INVENTION

The present invention relates to the field of gates, particularly to an assault-resistant gate for baring passage of large vehicles moving at high speed.

BACKGROUND OF INVENTION

Gates have been used throughout history to bar the passage of hostile persons from secure enclosures. It is well-known in the art that by making a gate and its mountings heavier, the gate can be made to withstand impacts of higher energy levels. However, a heavy gate takes longer to open than a light gate unless powerful opening or swinging means are utilized. A heavy gate moving at high speed under the impetus of a powerful swinging means can provide a hazard to persons or vehicles which may be struck or pinned by an opening or closing gate.

It is the object of the present invention to bar an opening with a gate which is as light as possible yet which will effectively resist an impact by a large vehicle such as a heavy truck travelling at high speed. Specifically it is an object to stop a seven-ton truck travelling at about 50 miles-per-hour. It is another object of the present invention to absorb such an impact while suffering damage only to inexpensive and easily replaceable components of the gate. A further object of the invention is to provide a barrier to unauthorized persons as well as vehicles. It is a further object in the present invention to provide a gate which has an attractive and impressive appearance.

BRIEF DESCRIPTION

The present invention comprises an assault-resistant gate. The gate has a relatively strong hinge-post means such as a hinge-post at one end of the opening to be barred. Extending from the hinge-post across the opening is a beam means such as a beam comprised of a pair of aluminum I-beams, oriented one above the other with their I's laid horizontally and joined together by transverse panels called stiffeners. The beam is mounted to the hinge-post means by a relatively weak breakaway mounting means. This breakaway mounting means may be a pair of box tubes extending from the hinge-post to the beam that have been split and tack-welded together or bolted together with relatively small bolts so that if the I-beam is subject to an impact, the breakaway mounting will permit the beam to separate from the hinge-post without deforming the hinge-post. This protects the hinge-post which will contain relatively expensive hydraulic gate swinging means. On the hinge-post side of the opening and on the distal side of the opening, energy absorbing means are disposed behind the beam. This energy absorbing means comprises at least a relatively rigid and heavy footing means such as a concrete wall which extends down beneath the soil and is joined to an extensive concrete footing system. Preferably this energy absorbing means will include a cushion means between the beam means and the footing means. This cushion means may comprise a rigid cellular material such as aluminum, composite or steel honeycomb. Such a material will absorb energy by progressively crushing on impact. After each impact the honeycomb would simply be replaced. Alternatively, the cushion can comprise a pad of resilient and flexible material such as a polymer pad of the type seen on railroad track terminal barriers.

The beam means is relatively rigid in a horizontal plane. Thus, when a heavy vehicle travelling at high speed impacts that beam, the beam does not deform or bend. Its horizontal dimension across the opening remains essentially the same. The beam shears the breakaway mounting means from the relatively strong hinge-post and is forced into the energy absorbing means. The energy absorbing means absorbs whatever energy has been transferred from the vehicle to the beam and thus brings the motion of the beam to a halt in a short distance such as one or two feet. Since the crush resistance or deformation resistance of the cushion means is significantly less than the amount of energy required to bend the rigid beam, the beam cannot be bent or folded to a shape or dimension which would fit between the footings on either side of the opening. If any energy remains after the pads or cushions have been completely crushed, that energy can be absorbed by the concrete footings or by a slight bending of the beam means. In practice, it is likely that most of the energy will be absorbed by the inelastic deformation of the vehicle as it collides with the beam means. The cushion means need only absorb what energy remains.

In addition to stopping vehicles, it is also desirable that the gate bar access to unwelcome persons who might otherwise simply climb over the I-beams. Toward this end, a panel means such as a decorative aluminum filigree extends up above the I-beams to a height which cannot easily be scaled by a human being. Rather than give these decorative elements more strength than is necessary to stop a person and thus encumber the gate with additional weight, these decorative elements are designed to break away on the impact of a large vehicle.

The filigree is designed as an interchangeable insert, which may easily be bolted onto the gate. Thus, the gate manufacturer may offer a number of different design options, including custom designs. The filigree may be electrified with a low-amperage non-fatal charge to discourage climbing of the gate.

In addition to the decorative panel, a decorative element having a symbolic nature can be placed upon the outer surface of the gate. By making this element of a strong metal and of sufficient dimensions, it is imparted with means for surviving an impact by a heavy truck at high speed without suffering substantial harm. Such a symbol's survival of a violent assault may have a psychological impact which might discourage further such assaults.

The hinge-post means will preferably incorporate a hydraulic means for swinging the beam clear of the opening and for swinging the beam closed. Preferably, this hydraulic means will comprise a helical drive. The hydraulic helical drive is propelled by a flow of hydraulic fluid which is driven by a hydraulic pump powered by electricity. The electricity is supplied by battery means such as rechargeable storage batteries, so that the gate can be operated even if power from a remote source fails. These batteries are recharged by a power converter which is supplied by power from a remote source such as the local power system or a generator. The system is shipped with its own power source, enabling it to be installed anywhere in the world. It may even be equipped with a solar charger for total independence of the local power grid. The storage batteries may hold sufficient charge, under some conditions, for about a thousand openings of the gate. A typical embassy gate opens and closes about thirty times per day. Thus the gate might remain operable for weeks without outside power. Both the hingepost means and the beam means comprise modular means for relatively simple installation, replacement and repair. The cushion means is also a module which is easily installed, replaced and repaired.

The hydraulic pump is actuated by system control means such as a system controller. Traffic signal means such as a traffic light is controlled by the system controller. The system controller generates signals related to the condition of the gate. Thus, when the gate is closed, a red stop light will be displayed. As the gate swings open, a yellow light will be displayed, possibly indicating the words "keep back". When the gate is completely in the open position, the signal will display a green light. The yellow light will be displayed prior to the closing of the gate followed by the red light just before the gate begins to close. Infrared or ultrasonic sensors can also feed information to the system controller so that the gate will not be traversed through an arc in which a person or a vehicle are disposed. An optional safety edge on the gate or hydraulic pressure sensors in the hydraulic system can indicate to the controller whether the gate is impacting on something within its arc, and the controller can be programmed to stop the gate immediately by simply deactuating the hydraulic pump. These safety features could be manually overridden during a life-threatening assault.

The microprocessor based system controller is generally controlled by a control panel means such as a control panel. The control panel means may comprise a plurality of stations. The controller may be connected to a telephone system and controlled thereby with signals transmitted over telephone lines from a remote location. The communication may be two-way, with the gate transmitting information, pictures or voice transmissions from the gate to the remote control station.

As a further refinement, the system controller can incorporate means for assessing the operating condition of the gate. Faults may be diagnosed from a remote location by signals communicated with a system controller over the telephone lines.

As a further refinement, the gate can comprise means for effecting some repairs by signals transmitted over the telephone lines to the system controller.

The hinge-post preferably comprises a housing and a hydraulic swing means such as the helical drive and hydraulic pump.

There are at least two possible approaches to hinging the gate beam on the hinge post. The preferred approach uses a hydraulic pivot helical gear such as a HELAC pivot actuator which is designed to handle bearing loads transverse to its shaft axis. The pivot actuator may be mounted atop the hinge-post and serves as both actuator and hinge.

Should a pivot actuator be unavailable, the second approach utilizes a standard hydraulic rotary actuator in conjunction with a bearing means external to the actuator for bearing the transverse loads.

Although typical capacity for hydraulic actuators is 3,000 p.s.i., a relief valve is included in the hydraulic lines, limiting pressure to 500 p.s.i. This serves to protect persons, animals and vehicles in the path of the rotating gate beam by limiting the force exertable by the gate.

The second hinge element may be a roller bearing means which may pivot by roller bearings which roll around the housing.

An important part of the hinge-post is a mounting flange which is preferably mounted atop a plurality of threaded rods. These rods have a portion embedded in a concrete footing. The rods have a lower set of height adjusting nuts on which the flange rests. Once the flange is in place, an upper set of securing nuts secure the flange and its hinge-post onto the footing. This provides a means for easy mounting and demounting of the hinge-post and for easy adjusting of either the height or attitude of the hinge-post in order to place the beam at its correct elevation and attitude for being disposed in front of the energy absorbing means when the beam is in its closed position and for clearing the ground during the beam's swing.

The above-described embodiment is preferred for its impact absorbing capability in locations where there is room in a horizontal plane to swing the gate. However, in some locations this room will not be available and an embodiment in which the gate swings vertically would be preferred. Towards this end, the hinge-post means of the vertically swinging embodiment comprises a helical drive with a horizontally oriented axis. The helical drive rotates a beam means in a vertical arc clear of an opening. The beam means will be rigid in a horizontal plane but, since lightness is at a great premium in a vertically swinging gate, the beam will be made of such high-tech composite materials as Kevlar and carbon-fiber reinforced plastic. Use of such materials enables the beam to be extremely light and yet still retain its rigidity in a horizontal plane. The lightness allows the use of a smaller counterweight, a smaller drive means, and a smaller lever arm on the counterweight, thus eliminating the need for excavation below the pivot point to allow clearance of the counterweight. The features of a relatively strong hinge-post means, breakaway mounting means, and energy absorbing means disposed behind the beam are all incorporated in the vertically swinging embodiment. Mercury displacement switches, proximity switches, infrared sensors, or cam-actuated roller switches can be used to limit the travel of the gate and to confirm that, when the gate stops its swing in the closed position, the beam is disposed in front of the energy absorbing means.

The primary advantage of the present invention is that it can withstand an assault of a very large vehicle moving at high speed. It does this using a light-weight structure which is easily swung open and closed with alacrity and with a minimum of danger to anyone who might be in its path. It can provide a barrier to personnel as well as to vehicles. It can be easily and inexpensively repaired following an impact. It continues to operate during power outages. Its modular components are easily installed, replaced or repaired. It can be controlled locally or from remote locations and even by telephone from anywhere in the world. In the event of a failure, its faults can be diagnosed remotely by telephone and, in some cases, even corrected by telephone.

Its mounting means allows easy adjustment of its attitude and altitude to compensate for imprecise installation or shifting ground.

BRIEF DESCRIPTION OF THE DRAWINGS

FIG. 3 is a front elevation of the gate after impact by a truck.

FIG. 4 is a plan view taken in section along the plane indicated in FIG. 3 as "4" of the gate after such impact.

DETAILED DESCRIPTION OF THE DRAWINGS

Figure 1:
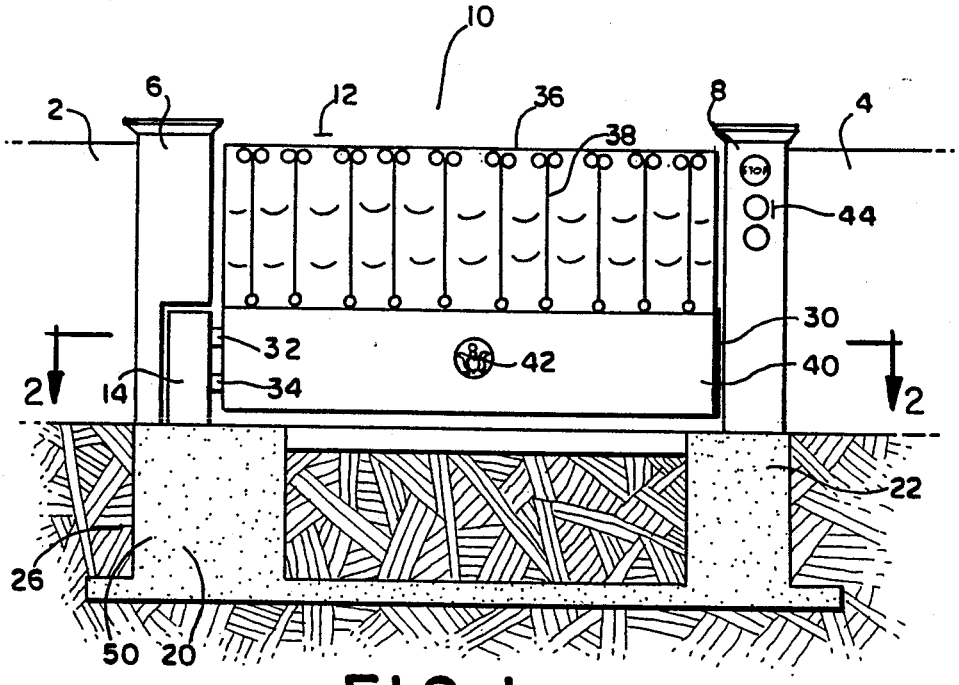
FIG. 1 is a partially sectional front elevation of the gate of the present invention barring an opening, the earth beneath the gate being shown in a section taken through a plane shown in FIG. 2 and designated "1".

FIG. 1 shows a preferred embodiment of an assault resistant gate of the present invention. Walls 2 and 4 are bounded by columns 6 and 8 which define an opening 10 which is barred by the gate of the present invention, generally designated 12. The gate 12 comprises relatively strong hinge-post means such as hinge-post 14 which is mounted securely to base 50 of footing 20 in the earth 26. The subsurface earth in FIG. 1 is shown in a section taken through a plane indicated in FIG. 2 along line "1".

The beam means 30 is mounted to hinge-post 14 by breakaway mounting means 32-34. Associated with beam means 30, is a panel means, such as panel 36, for barring passage by people through opening 10. Panel 36 preferably comprises decorative elements such as a cast aluminum filigree 38. Although this filigree is of sufficient strength to resist the passage of a person, weight is saved by making it of insufficient strength to resist the impact of a vehicle and it is therefore designed to break away from beam 30, on vehicular impact. Beam 30 has a facade comprising a decorative panel 40. On panel 40 is mounted a decorative element of a symbolic nature, such as emblem 42. Emblem 42 is designed of such material and dimension that is has sufficient strength to survive an impact by a heavy truck at high speed without suffering substantial harm.

Traffic signal 44 can be seen mounted on column 8.

Figure 2:
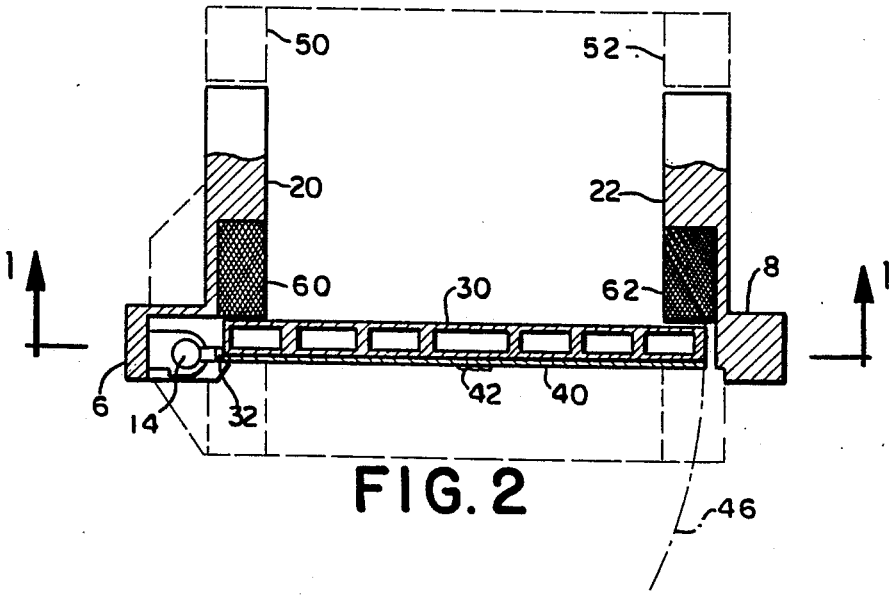
FIG. 2 is a plan view taken in section along a plane indicated in FIG. 1 as "2".
Figure 6:
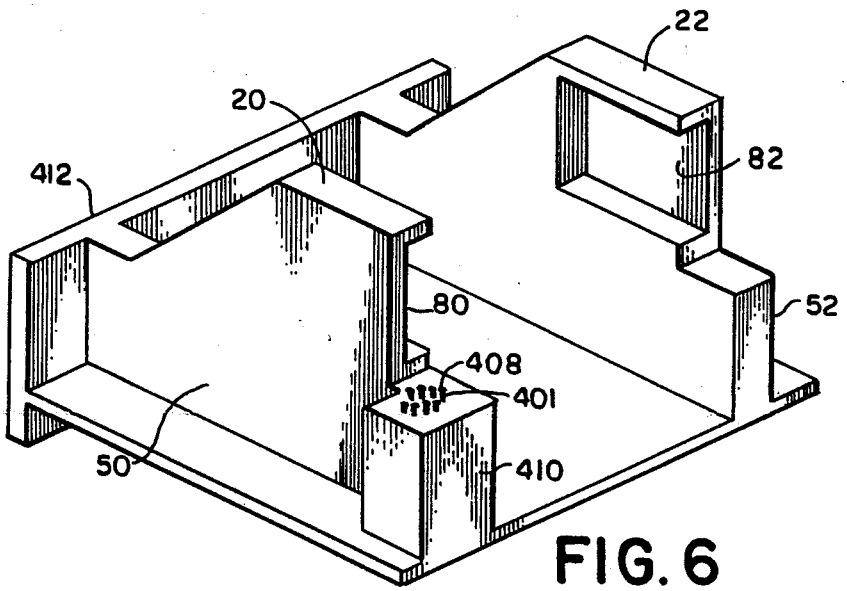
FIG. 6 is an orthogonal view of the footing means.

FIG. 2 shows a plan view of the gate taken in a section shown in FIG. 1 along line 2. Beam 30 can be seen mounted by breakaway mount 32 to hinge-post 14. Hinge-post 14 is enclosed within column 6. Beam 30 can be rotated on hinge-post 14 through arc 46. In its closed position as shown, beam 30 is disposed in front of energy absorbing means comprising relatively rigid and heavy footing means such as footings 20, 22, the bases 50, 52 of which are embedded in the subsurface soil. An uncovered orthogonal view of the footing means is shown in FIG. 6.

Figure 5:
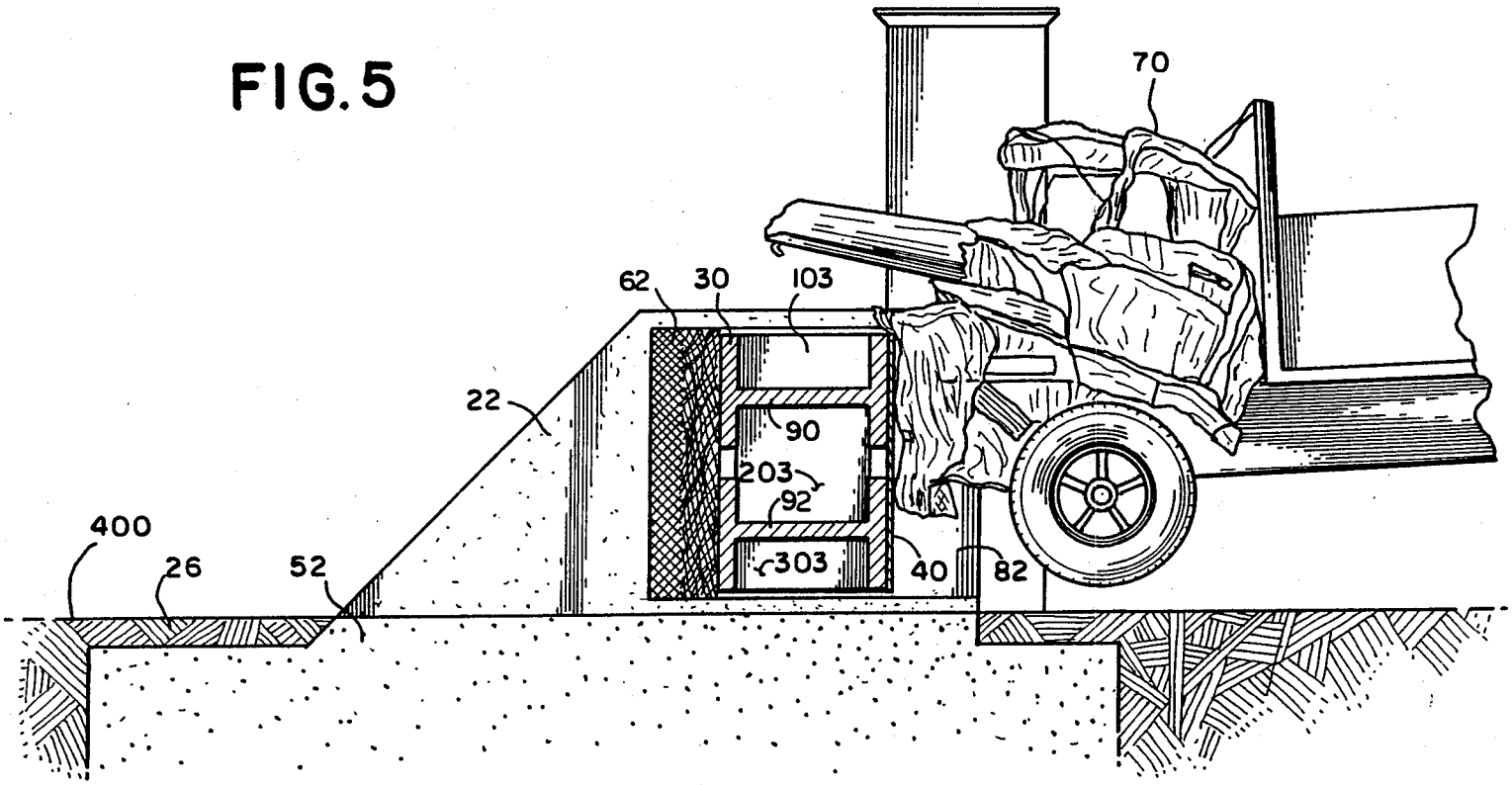
FIG. 5 is a side elevation of the gate after impact by a truck taken in section above the surface along a plane indicated in FIG. 4 as "5*a*", and below the surface along a plane indicated in FIG. 4 as "5*b*".

As shown in FIG. 2, cushion means such as cushions 60, 62 are incorporated into footings 20, 22 and are disposed between the beam 30 and the concrete of footings 20, 22. These cushions may be comprised of a rigid cellular material, such as aluminum, steel or composite honeycomb, which absorbs energy by progressively crushing on impact, as shown in FIGS. 4 and 5. The presently preferred honeycomb is UNICEL 5052 Al . Alternatively, each cushion may comprise a pad of resilient and flexible material, such as a polymer pad of the type found on the terminal barriers of railroad tracks.

When a vehicle such as truck 70, as shown in FIG. 3, impacts upon gate 12, it shears breakaway mounts 32, 34, which allows beam 30 to be driven by the impact into cushions 60, 62 as shown in FIG. 4. Cushions 60 and 62 progressively crush upon impact with a resistance which is less than the bending resistance of beam 30, absorbing the energy of the collision in the process.

As beam 30 travels, its ends are guided by channels 80, 82 formed in footings 20, 22, so that beam 30 remains disposed in front of cushions 60, 62 throughout its energy absorbing travel. As can be seen in FIG. 5, most of the energy of the impact is absorbed by the progressive deformation of the front of truck 70 as it impacts on beam 30. The remainder of the energy is absorbed as beam 30 crushes cushion 62 against footing 22. As can be seen in FIG. 5, beam 30 comprises a pair of I-beams 90, 92 joined together by transverse panels, such as stiffeners 103, 203, 303, which can also be seen in FIG. 4 101–108. These transverse panels are welded to the I-beams and are spaced about 16" on their centers. This pair of I-beams is fronted by decorative panel 40 (FIGS. 1–5).

As is also shown in FIG. 5, footing 22 extends below surface 400 as base 52 which is embedded in earth 26. The footing means can be seen more clearly, free of its soil covering, in FIG. 6.

The cushion means, not shown in FIG. 6, reside in channels 80, 82. On impact, the beam is driven into these cushion means and transfers its energy through the cushions to footings 20 and 22 which in turn transfer energy to the back flange 412. The back flange 412 spreads the energy over a large area of sub-surface earth rendering the entire footing structure very difficult to displace.

Figure 7:
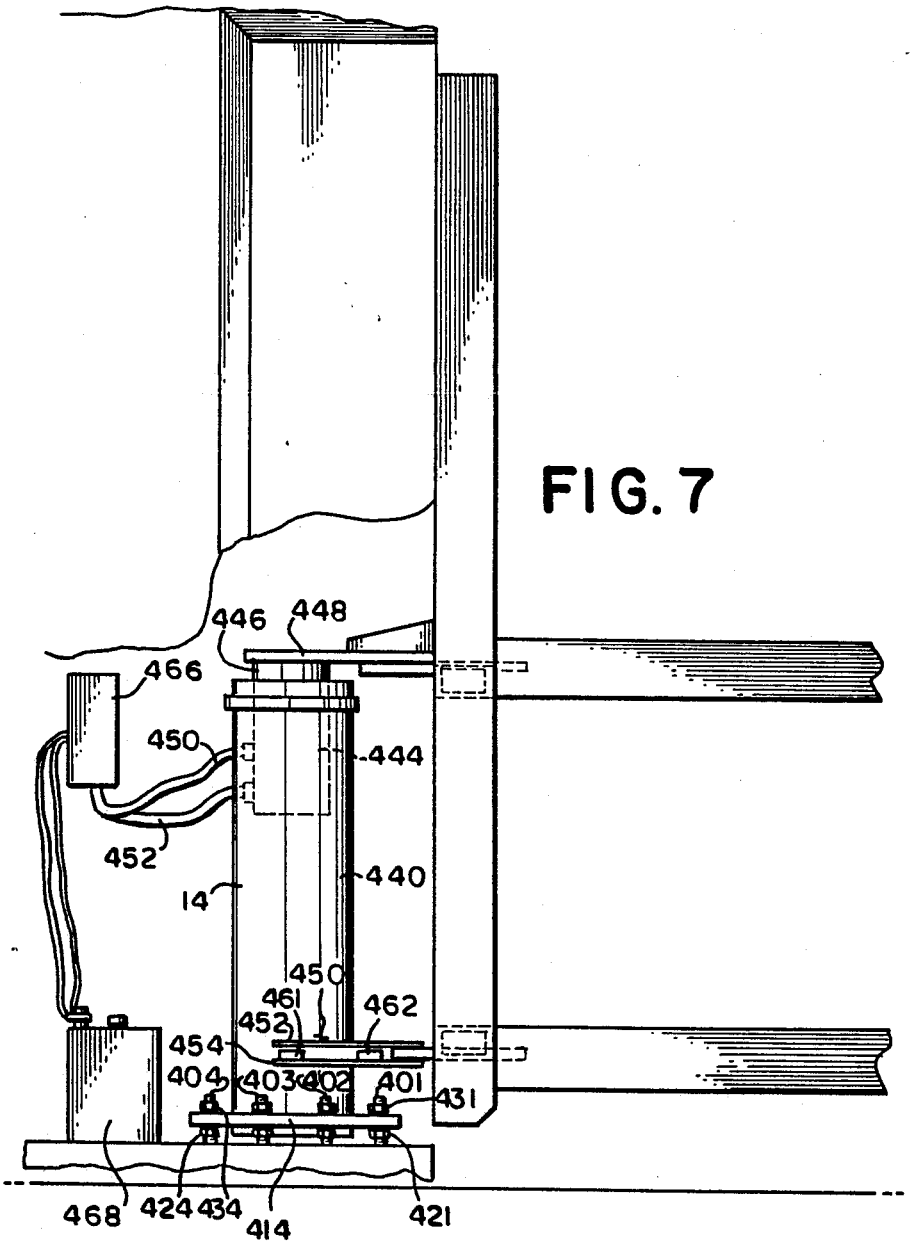
FIG. 7 is a front elevation of the hinge-post.

Threaded rods 401–408 are embedded in and project from the top of a forward buttress 410 of base 50. The tops of these rods are shown again in FIG. 7 where they are used to mount mounting flange 414 of of hinge-post 14. Lower spacing nuts 421–428 are threaded onto the rods first and are used to adjust the altitude and attitude of hinge-post 14. Flange 414 rests on these lower nuts. Upper nuts 431–438 are tightened atop flange 414 to secure it onto the threaded rods.

This arrangement of a strong flange bolted to a plurality of studs provides a relatively strong mounting for the relatively strong cylindrical housing 440 of hinge-post 14. Within and at the top of this housing is located a helical hydraulic actuator such as a HELAC flange mounted pivot actuator, Model 60K of HELAC Corporation of Enumaclaw, Wash. 98022, represented as 444 in dashed lines within and at the top of housing 440. Helical actuator 444 imparts a rotational movement to shaft 446 which serves as an upper hinge pin for gate hinge 448.

Depending on which way hydraulic fluid is pumped through hydraulic lines 450, 452, hinge 448 is rotated in either a clockwise or counterclockwise direction in a horizontal plane. As a lower hinge, bearing jaws 450 comprise a pair of horseshoe-shaped plates 452, 454, between which bearings 461–464 are mounted. The downward rotational movement caused by the length and weight of the gate pinned at hinge 446, presses jaws 450 against housing 440 so that roller bearings 461–464 roll along the outer surface of housing 440 when the gate is pivoted.

Figure 15:
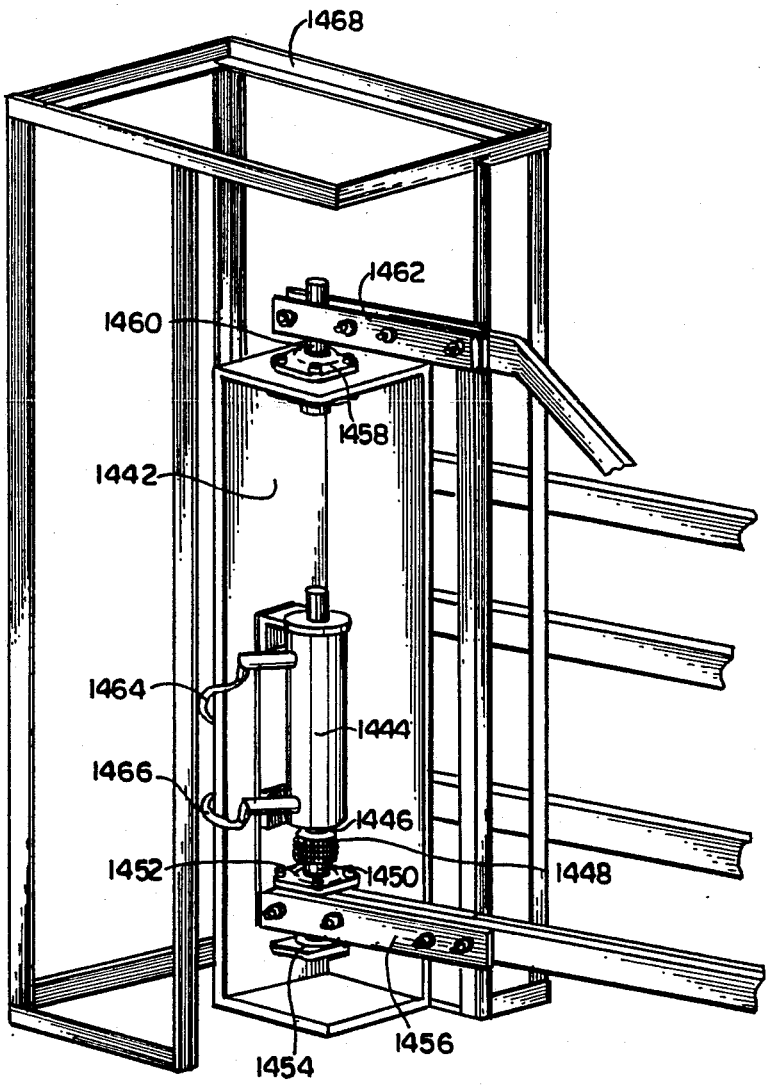
FIG. 15 is a perspective view of an alternative hydraulic actuator.

FIG. 15 shows an alternative hydraulic actuator which may be used when a pivot actuator is not available. 1442 is a housing on which the actuator and hinges are mounted. Rotary actuator 1444 is mounted in the housing 1442. Shaft 1446 depends from actuator 1444 and is coupled by means of drive chain 1448 to a second shaft 1450 there below. Shaft 1450 is mounted on bearings 1452, 1454 which are also welded to housing 1442. Gate hinge 1456 is affixed to shaft 1450 and pivots therewith. On top of housing 1442, bearing 1458 carries shaft 1460 which projects from the top of bearing 1458. Hinge 1462 is affixed to shaft 1460 and provides the top hinge on which the gate is pivoted. Hydraulic lines 1464, 1466 couple the actuator to a hydraulic pump (not shown). The entire hinge post assembly is enclosed by a hinge post enclosure of which the frame 1468 is shown in FIG. 15.

Actuator 444 is driven by hydraulic fluid pumped through hydraulic lines 450, 452 by integral hydraulic pump 466 which comprises a pump driven by an electric motor. The gate is rotated in a clockwise or counterclockwise direction depending upon the direction of flow of the hydraulic fluid, which in turn depends upon the direction of rotation of the pump motor. Power is supplied to the electric motor of the integral pump by cables running to deep-discharge-cycle type electrical storage batteries 468, 469.

Figure 8:
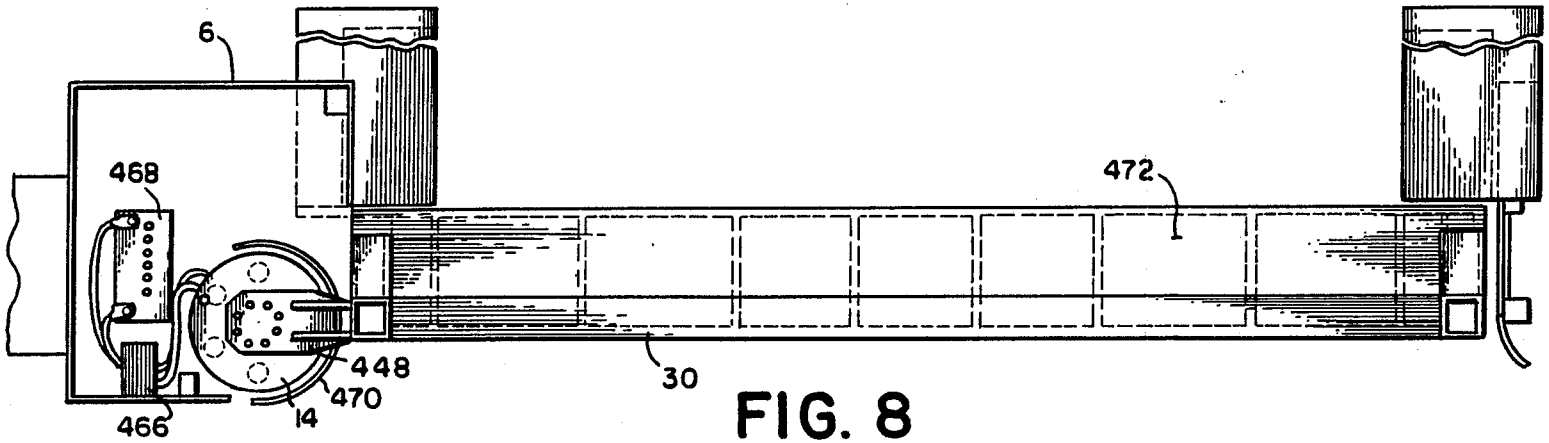
FIG. 8 is a more detailed plan view of the gate showing the hinge-post and the beam.

FIG. 8 is a plan view of the gate showing more detail than FIGS. 2 and 4. Hinge-post 14 is partly surrounded by a copper shroud 470 mounted to hinge-arm 448 and to the lower jaws. When the gate rotates, the shroud conceals and protects hinge-post 14 within column 6. Beam 30 is covered by a plate 472 of one-fourth inch thick aluminum such as 6061 T-6.

Figure 9:
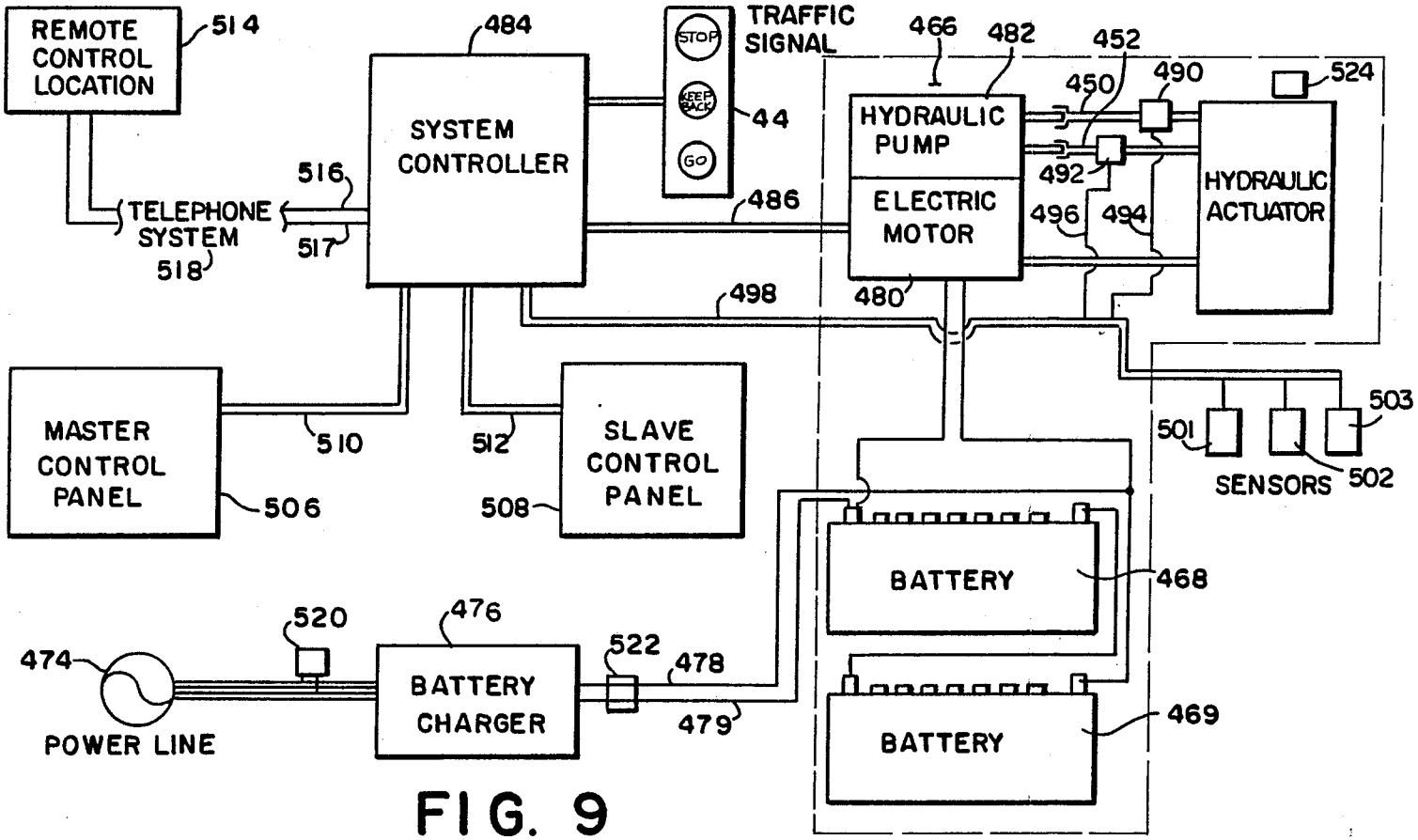
FIG. 9 is a block diagram in the nature of a schematic showing various components of the gate.

FIG. 9 is a block diagram of the system. Electrical power comes from a local power company and is transmitted by a power line represented by 474 to a battery charger 476. The battery charger converts the line voltage to a battery voltage such as twenty-four volts which is transmitted by wires 478, 479 to a pair of deep-discharge-type 12 volt storage batteries 468, 469. Power is supplied from these batteries to an electric motor 480 which drives hydraulic pump 482. The motor and pump comprise an integral pump motor unit 466. The electric motor is turned off or on in one direction or another by the system controller 484 which controls the electric motor through control cable 486. Depending on which direction the hydraulic pump is turning, the hydraulic fluid flowing through hydraulic lines 452 rotate the hydraulic actuator in either a clockwise or counterclockwise direction. Pressure sensors 490 and 492 in these hydraulic lines, signal the system controller 484 via wires 494, 496 and cable 498. When the pressure in either hydraulic line exceeds a predetermined value for a given angle of the gate, the system controller can assume that the gate has encountered the resistance of an object in its arc. The controller can then stop the electric motor to prevent further damage to the object. Other sensors such as 501–503 can scan the arc of the gate with infrared, ultrasonic, or microwave signals to sense objects within the arc. The sensors may comprise switches actuated by pressure bars on the edge of the gate or on the surfaces of the gate. All these sensors have the objective of preventing the gate from damaging a person or object in its path. Also towards this end, a traffic signal 44 is controlled by the system controller.

The system controller opens and closes the gate according to commands from the various control panel means. These may be one or more stations such as master control panel 506 and slave control panel 508 which communicate with system controller via cables 510 and 512. Alternatively, the system controller can be controlled from a remote control location such as 514 which communicates with the system controller over telephone wires 516, 517 via telephone system 518. The remote control location can input the system controller via coded signals generated by a touch-tone key pad or by signals generated by a computer.

Additional sensors such as 520 to sense line voltage, 522 to sense battery and charger voltage, and 524 to sense actuator position can be used with sensors and condition status reporting means within the system controller. Pressure sensors 590 and 592 can be sensed by the system controller. Signals indicating the status of those sensors can be communicated by system controller 484 to remote location 514 over the telephone lines for the purpose of diagnosing faults in the gate from such a remote location.

Additionally, the system controller can comprise means for effecting some repairs by signals transmitted over the telephone lines to the system controller.

Figure 10:
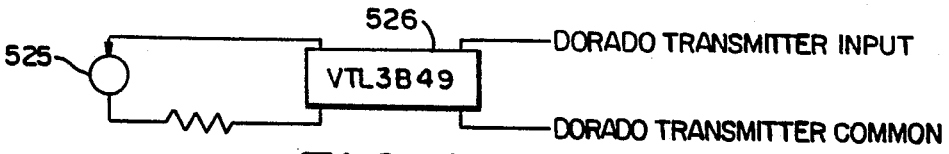
FIG. 10 is a schematic of a means for monitoring the condition of a node.

In diagnosing the system status, information is collected about the various input, output or internal status of the circuit and of the mechanical system. This information is then conveyed over a normal voice-grade phone line and is then displayed at a remote location for interpretation. Telephone line compatibility is accomplished through the use of Dorado Systems Series 300 multiplex signalling modules, forming a sub-system consisting of a multiplex transmitter and receiver pair. Each transmission-receiver pair will communicate six individual bits of information. This information can be the presence or absence of power at a particular node; the presence or absence of a particular switch closure, or relay closure; or the logic level of a particular node. The sensing of line voltage at a particular node 525 involves the use of a photo-isolator 526 such as a Vactec No. VTL3B49 as in FIG. 10.

Figure 11:
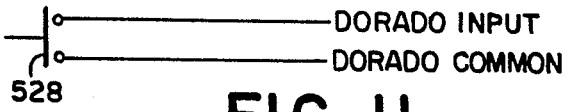
FIG. 11 is a schematic of a means for monitoring a switch closure.
Figure 12:
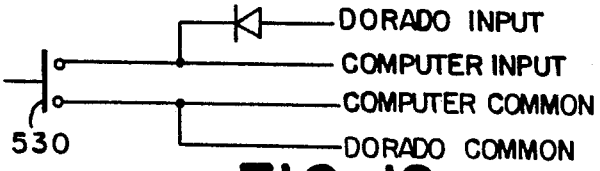
FIG. 12 is a schematic of a means for remotely monitoring a switch closure and for monitoring by the system controller of the switch closure.

As in FIG. 11, sensing a switch closure or relay closure 528 can be done directly.

Often a single switch closure 530 must signal both the computer and the Dorado transmitter. Since the computer senses at twenty-four volts DC and the Dorado senses at twelve volts DC, a diode 532 must be used to isolate the two systems.

In this telediagnostic-diagnostic system there is a display of the input status of each of the inputs to the transmitter by its paired receiver. The actual display is a panel of light-emitting diodes arranged for convenient viewing. These outputs may be frozen at present values or allowed to follow their corresponding inputs, as they fluctuate, to convey system's operation. Correct communication is verified by the display of a loss-of-communication alarm combined with a status verified indication. The former indicates zero percent reliability and the latter indicates one hundred percent reliability, and the combination of the two can be used to establish the possibility of telediagnostic-diagnostic error.

If six of the outputs of the computer are tied directly to the six inputs of the Dorado transmitter, a program can be used to encode sixty-four different combinations of input/output status and gate software mode status into a six bit binary code for subsequent transmission. If twelve bits are used, the total number of possible combinations rises to 4,096 individual states of input/output and program-mode status.

Figure 13:
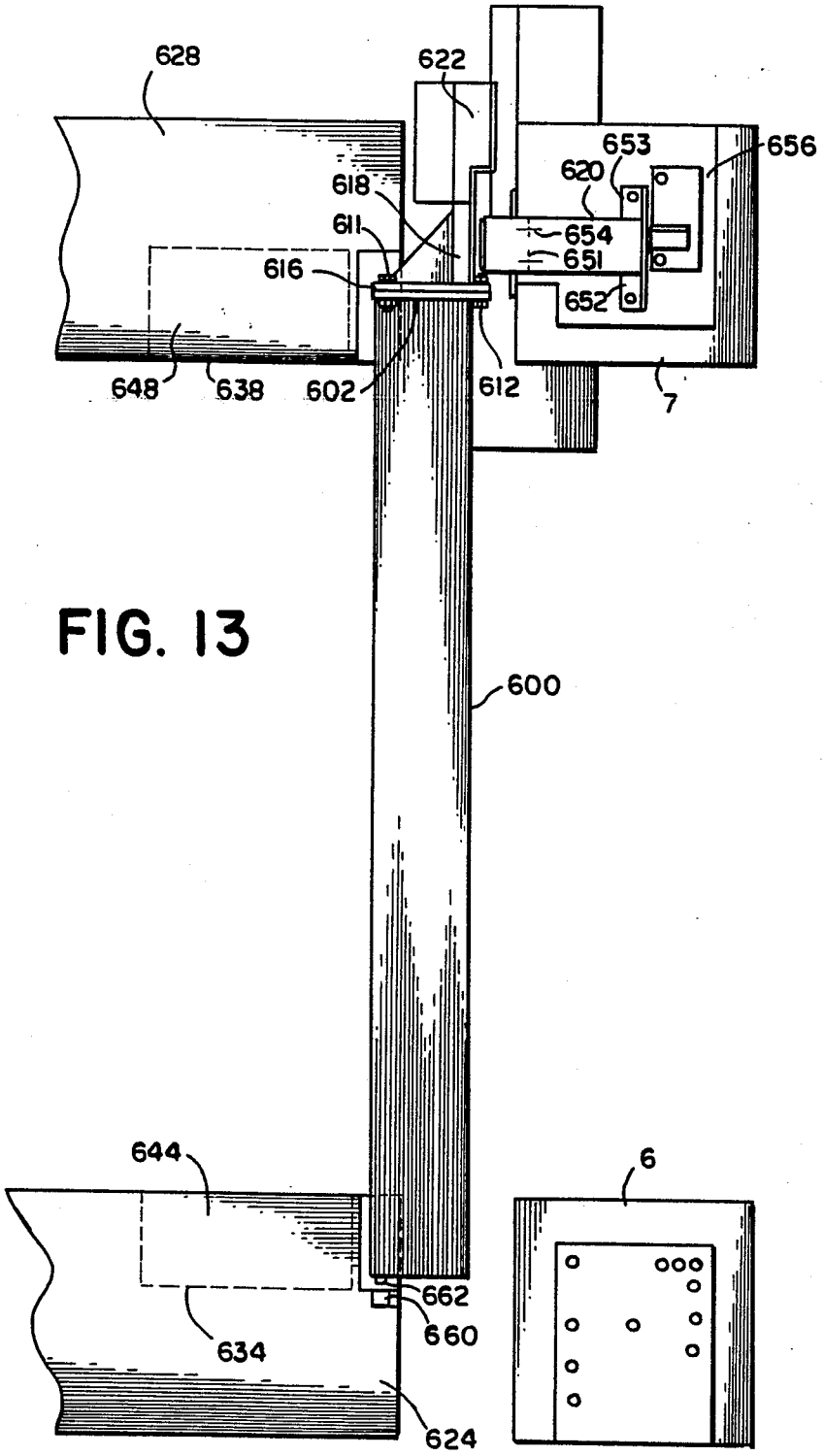
FIG. 13 is a plan view of an alternate embodiment of the invention having a vertically swinging gate.
Figure 14:
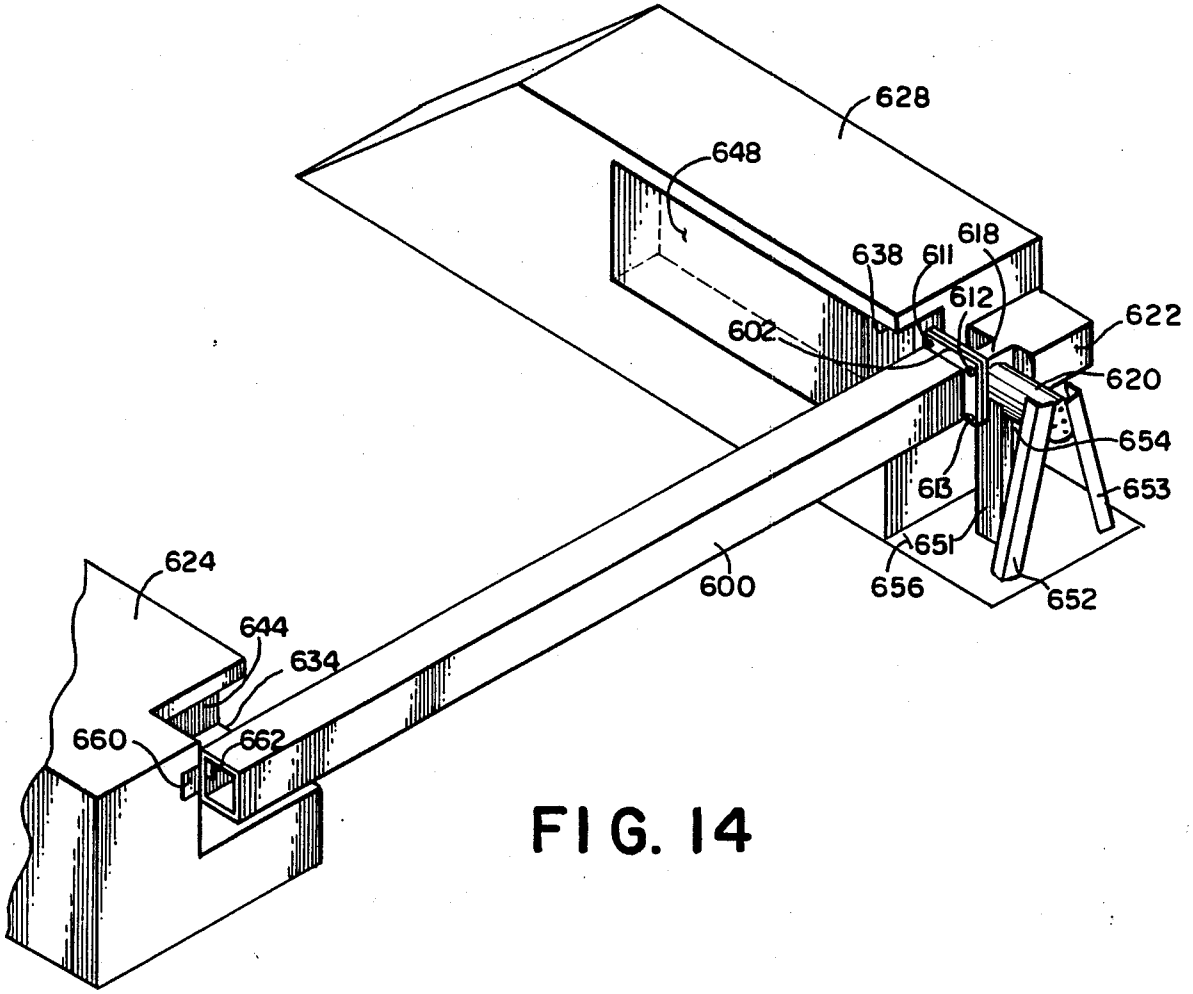
FIG. 14 is an orthogonal view of the alternative embodiment.

FIGS. 13 and 14 show an alternative embodiment of the gate. In this embodiment beam 600 swings vertically. Beam 600 is made of a composite of Kevlar and/or carbon fiber reinforced plastic and is extremely rigid in a horizontal plane. At its hinge-post side, beam 600 comprises a flange 602. Relatively small and weak bolts 611, 612, 613 secure flange 602 to flange 616. These flanges should be of steel or have steel surrounding each bolt hole. The relative weakness of the screws causes them to sheer on impact to serve as break-away mounting means for beam 600. Flange 616 is a part of hinge 618 which is rotatably mounted on helical hydraulic drive actuator 620 which is mounted with its rotational axis in a horizontal plane so that beam 600 can be rotated in a vertical plane. Counterweight 622 is mounted on hinge 618 opposite beam 600. The counterweight thereby balances beam 600 and reduces the amount of force due to gravity required to raise beam 600. Footings 624, 628 comprise energy absorbing means and are disposed behind beam 600. Channels 634, 638 are formed within footings 624, 628 and are disposed behind beam 600 at either end of said beam. Cushions 644, 648 are disposed within channels 634, 638 behind beam 600: On impact, beam 600 shears bolts 611–613 and is driven into cushions 644, 648 which progressively crush or compress to absorb the energy of the impact similarly to the previous embodiment.

Helical actuator 620 is mounted by legs of strong angle iron 651–654 to a base 656 of footing 628 so that the hinge-post means, which the actuator and its mounts comprise, is relatively strong when compared to the breakaway mounting means 611–613 for beam 600.

In order to make sure that when the gate is closed it is located in front of the channels 634, 638, there is provided a sensor means comprised of magnetic sensor 660 on footing 624 and magnet 662 on beam 600. When the gate 600 is rotated closed by actuator 620, the controller awaits the signal from sensor 660 that the magnet 662 is located in proximity to sensor 660. The system controller then stops supplying electricity to the hydraulic pump which thereby stops the rotation of actuator 620 and thereby beam 600 in the precisely correct position.

I claim:

1. An assault-resistant gate for barring passage, through an opening, of vehicles, said gate comprising:

a hinge-post means;

beams means, extending from the hinge-post means across the opening, said beam means being relatively rigid in a horizontal plane;

breakaway beam mounting means attaching the beam means to the hinge-post means, which mounting means is weaker than the hinge-post means;

energy-absorbing means, disposed behind said beam means at a hinge-post side and at a distal side of the opening for absorbing impact from the beam.

2. A gate according to claim 1 in which the energy-absorbing means comprises a relatively rigid and heavy footing means, embedded in a surface.

3. A gate according to claim 2 in which the energy-absorbing means further comprises cushion means between the beam means and the footing means.

4. A gate according to claim 3 in which the cushion means comprises a rigid cellular material which absorbs energy by progressively crushing on impact.

5. A gate according to claim 3 in which the cushion means comprises a pad of resilient and flexible material.

6. A gate according to claim 3 in which the hinge-post means, the beam means and the cushion means comprise modular means for relatively simple installation, replacement and repair.

7. A gate according to claim 6 having a system controller means for actuating the hydraulic pump means.

8. A gate according to claim 7 further comprising traffic signal means controlled by the system controller which generates signals related to conditions of the gate.

9. A gate according to claim 8 having control panel means.

10. A gate according to claim 9 in which the control panel means comprise a plurality of stations.

11. A gate according to claim 1 further comprising panel means associated with the beam means for barring passage by people through the opening.

12. A gate according to claim 11 in which said panel means comprised decorative elements.

13. A gate according to claim 12 in which at least some of the decorative elements are designed to break away on impact.

14. A gate according to claim 12 in which the decorative elements are filigree.

15. A gate according to claim 1 in which the hinge-post means comprises:

a post, the post having hydraulic means associated therewith to actuate movement of the beam means.

16. A gate according to claim 1 further comprising hydraulic means for swinging the beam means clear of the opening and for swinging the beam means closed.

17. A gate according to claim 16 in which the hydraulic means comprises a helical drive.

18. A gate according to claim 16 in which the hydraulic means comprises a hydraulic pump means powered by electricity.

19. A gate according to claim 18 in which the electricity is supplied by rechargeable battery means.

20. A gate according to claim 19 further comprising recharging means for converting power from a remote source.

21. A gate according to claim 20 in which the remote source is the sun.

22. A gate according to claim 7 having a system controller which may be communicated with, from a remote location, and controlled by signals transmitted over telephone lines.

23. A gate according to claim 22 comprising means for assessing the operating condition of the gate, and for diagnosing faults in the gate from a remote location, by signals communicated with the system controller over the telephone lines.

24. A gate according to claim 23 comprising means for effecting some repairs by signals transmitted over the telephone lines to the system controller.

25. A gate according to claim 15 in which the post is secured to a mounting flange mounted atop a plurality of threaded rods, said rods having a lower portion embedded in a footing;

said rods having a lower set of height-adjusting nuts on which the flange rests;

said rods having an upper set of securing nuts.

26. A gate according to claim 1 in which the hinge-post means and the beam means comprise modular means for relatively simple installation, replacement and repair.

* * * * *

UNITED STATES PATENT AND TRADEMARK OFFICE

CERTIFICATE OF CORRECTION

PATENT NO. : 4,916,859

DATED : April 17, 1990

INVENTOR(S) : Colin Butler

It is certified that error appears in the above-identified patent and that said Letters Patent is hereby corrected as shown below:

Column 6, line 61, after "flange 414" delete "of";

In claim 1 at column 10, line 1, "beams means" should be --beam means--; and

In claim 7 at column 10, line 26, "claim 6" should be --claim 18--.

Signed and Sealed this

First Day of October, 1991

*Attest:*

HARRY F. MANBECK, JR.

*Attesting Officer*

*Commissioner of Patents and Trademarks*